US009601820B2

(12) United States Patent
Herbsommer et al.

(10) Patent No.: US 9,601,820 B2
(45) Date of Patent: Mar. 21, 2017

(54) DIELECTRIC WAVEGUIDE COMPRISED OF A CORE SURROUNDED BY A CLADDING AND FORMING INTEGRATED PERIODICAL STRUCTURES

(71) Applicant: Texas Instruments Incorporated, Dallas, TX (US)

(72) Inventors: Juan Alejandro Herbsommer, Allen, TX (US); Benjamin S. Cook, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 49 days.

(21) Appl. No.: 14/579,842

(22) Filed: Dec. 22, 2014

(65) Prior Publication Data

US 2015/0295300 A1 Oct. 15, 2015

Related U.S. Application Data

(60) Provisional application No. 61/977,407, filed on Apr. 9, 2014.

(51) Int. Cl.

| | |
|---|---|
| ***H01P 3/16*** | (2006.01) |
| ***H01P 1/20*** | (2006.01) |
| ***H01P 11/00*** | (2006.01) |
| ***H01P 3/12*** | (2006.01) |
| *H01P 1/211* | (2006.01) |

(52) U.S. Cl.

CPC ..... *H01P 3/16* (2013.01); *H01P 1/2002* (2013.01); *H01P 3/122* (2013.01); *H01P 11/006* (2013.01); *H01P 1/211* (2013.01)

(58) Field of Classification Search

CPC ..... H01P 1/211; H01P 1/2002; H01P 3/16; H01P 3/165; H01P 3/18

USPC ..... 333/208, 210

See application file for complete search history.

(56) References Cited

U.S. PATENT DOCUMENTS

| | | | | |
|---|---|---|---|---|
| 4,463,329 | A * | 7/1984 | Suzuki | H01P 11/006 264/127 |
| 4,538,123 | A * | 8/1985 | Mariani et al. | H01P 1/213 333/1.1 |
| 2014/0287701 | A1 | 9/2014 | Herbsommer et al. | |

OTHER PUBLICATIONS

"Quasi-Optical Notch Filter for ECEI Systems", The University of California Davis Millimeter-Wave Research Center, 2012.

"3D Printing", Wikipedia, pp. 1-35, available at http://en.wikipedia.org/w/index.php?title=3D_printing&oldid=624190184 on Sep. 4, 2014.

* cited by examiner

*Primary Examiner* — Benny Lee

(74) *Attorney, Agent, or Firm* — John R. Pessetto; Charles A. Brill; Frank D. Cimino

(57) ABSTRACT

A dielectric waveguide interconnect system has a dielectric waveguide (DWG) a core surrounded by a cladding along the length of the DWG. One or more periodic structures are embedded along the length of the DWG such that the core of the DWG is integral to each of the one or more periodic structures.

15 Claims, 8 Drawing Sheets

DIELECTRIC WAVEGUIDE COMPRISED OF A CORE SURROUNDED BY A CLADDING AND FORMING INTEGRATED PERIODICAL STRUCTURES

CLAIM OF PRIORITY UNDER 35 U.S.C. 119(e)

The present application claims priority to and incorporates by reference U.S. Provisional Application No. 61/977,407 filed Apr. 9, 2014, entitled "Method to Integrate Periodical Structures with Dielectric Waveguides to Control the Dispersion and Frequencies Response of Interconnects using Direct-Write Printing Manufacturing Process."

FIELD OF THE INVENTION

This invention generally relates to wave guides for high frequency signals, and in particular to waveguides with dielectric cores.

BACKGROUND OF THE INVENTION

In electromagnetic and communications engineering, the term "waveguide" may refer to any linear structure that conveys electromagnetic waves between endpoints thereof. The original and most common meaning is a hollow metal pipe used to carry radio waves. This type of waveguide is used as a transmission line for such purposes as connecting microwave transmitters and receivers to antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the "relative permittivity ($\in k$)". The term "insulator" is generally used to indicate electrical obstruction while the term "dielectric" is used to indicate the energy storing capacity of the material by means of polarization.

Permittivity is a material property that expresses a measure of the energy storage per unit meter of a material due to electric polarization $(J/V^2)/(m)$. Relative permittivity is the factor by which the electric field between the charges is decreased or increased relative to vacuum. Permittivity is typically represented by the Greek letter $\in$. Relative permittivity is also commonly known as dielectric constant.

Permeability is the measure of the ability of a material to support the formation of a magnetic field within the material in response to an applied magnetic field. Magnetic permeability is typically represented by the Greek letter $\mu$.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at the surface thereof.

BRIEF DESCRIPTION OF THE DRAWINGS

Particular embodiments in accordance with the invention will now be described, by way of example only, and with reference to the accompanying drawings.

DETAILED DESCRIPTION OF EMBODIMENTS OF THE INVENTION

Figure 1:
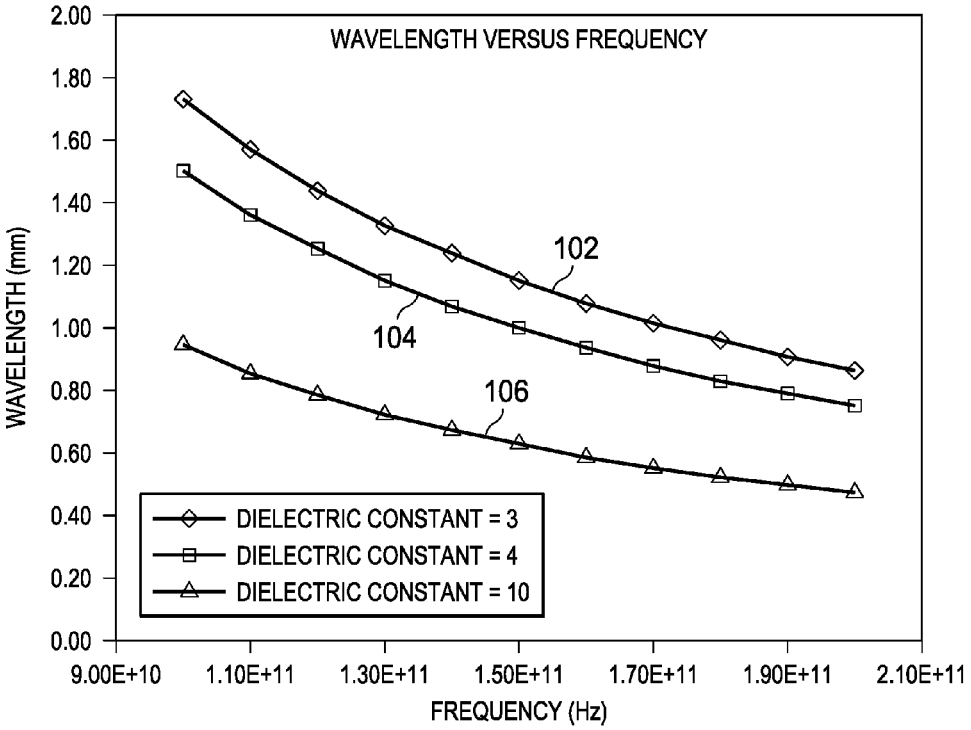
FIG. 1 is a plot of wavelength versus frequency through materials of various dielectric constants.

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

A dielectric waveguide (DWG) may be used as an interconnect to communicate chip to chip in a system or system to system, for example. As a signal propagates through a DWG, it may undergo magnitude and/or velocity changes due to the frequency response effects of frequency sensitive dielectric materials used to fabricate the DWG. While the signal may be "digital" in nature or be a continuous signal modulated to carry digital information, a digital signal may be represented and analyzed as a set of frequencies. Filter blocks or other periodic structures may be integrated into the DWG to control the frequency response of a DWG interconnect system, as will be described in more detail below.

As frequencies in electronic components and systems increase, the wavelength decreases in a corresponding manner. For example, many computer processors now operate in the gigahertz realm. As operating frequencies increase to the sub-terahertz (THz) realm, the wavelengths become short enough that signal lines that exceed a short distance may act as an antenna and signal radiation may occur. FIG. 1 is a plot of wavelength in mm versus frequency in Hz through materials of various dielectric constants. As illustrated by plot 102 which represents a material with a low dielectric constant of 3, such as a printed circuit board, a 100 GHz signal will have a wavelength λ of approximately 1.7 mm. Thus, a signal line that is only 1.7 mm in length may act as a full wave antenna and radiate a significant percentage of the signal energy. In fact, even lines of λ/10 are good radiators, therefore a line as short as 170 um may act as a good antenna at this frequency. Plot line 104 represents a material that has a dielectric constant of 4. Plot line 106 represents a material that has a higher dielectric constant of 10. As can be seen from plot lines 104, 106, materials having higher dielectric constant will allow radiation at even shorter lengths of signal lines.

Waves in open space propagate in all directions, as spherical waves. In this way they lose their power proportionally to the square of the distance; that is, at a distance R from the source, the power is the source power divided by $R^2$. A wave guide may be used to transport high frequency signals over relatively long distances. The waveguide confines the wave to propagation in one dimension, so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material therewithin (air, plastic, vacuum, etc.), as well as on the frequency of the wave. Commonly-used waveguides are only of a few categories. The most common kind of waveguide is one that has a rectangular cross-section, one that is usually not square. It is common for the long side of this waveguide cross-section to be twice as long as its short side. These are useful for carrying electromagnetic waves that are horizontally or vertically polarized.

A waveguide configuration may have a core member made from dielectric material with a high dielectric constant and be surrounded with a cladding made from dielectric material with a lower dielectric constant. While theoretically, air could be used in place of the cladding, since air has a dielectric constant of approximately 1.0, any contact by humans, or other objects may introduce serious impedance mismatch effects that may result in signal loss or corruption. Therefore, typically free air does not provide a suitable cladding.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides may have a wider range of operation without a fixed cutoff point. However, a purely dielectric waveguide may be subject to interference caused by touching by fingers or hands, or by other conductive objects. Metallic waveguides confine all fields and therefore do not suffer from EMI (electromagnetic interference) and cross-talk issues; therefore, a dielectric waveguide with a metallic cladding may provide significant isolation from external sources of interference. Various types of dielectric core waveguides will be described in more detail below.

Various configurations of dielectric waveguides (DWG) and interconnect schemes are described in U.S. Pat. No. 9,306,263, filed Apr. 1, 2013, entitled "Integrated Circuit with Dipole Antenna Interface for Dielectric Waveguide" by Juan Herbsommer, et al, and are incorporated by reference herein. Various antenna configurations for launching and receiving radio frequency signals to/from a DWG are also described therein and are incorporated by reference herein.

Figure 2:
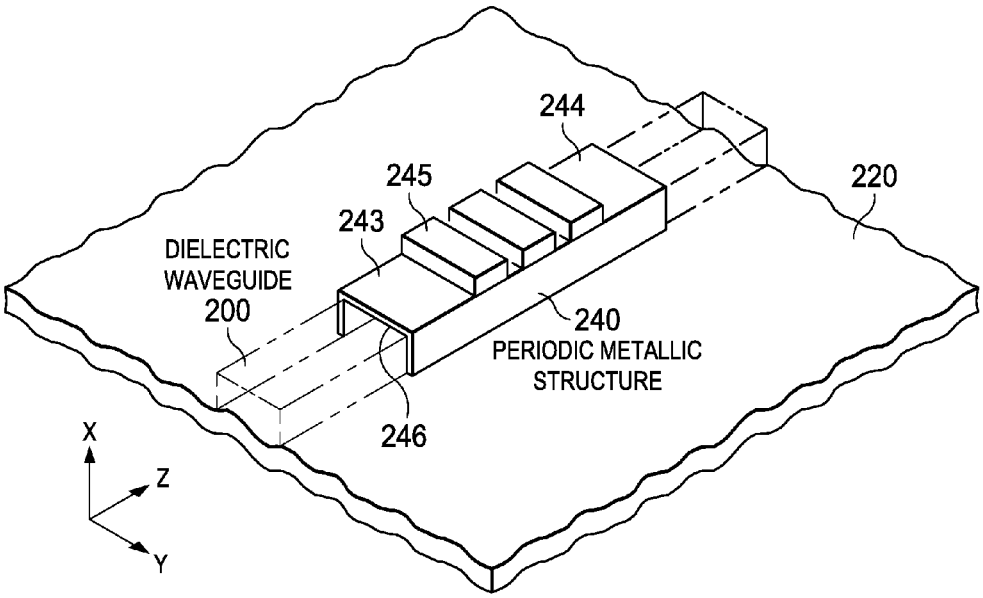
FIG. 2 is an illustration of a dielectric waveguide with integrated periodic structures.

FIG. 2 is an isometric illustration of a portion of a dielectric waveguide 200 with an integrated filter structure 240, also referred to herein as "periodic structure 240" and periodic metallic structure 240". Multiple copies of filter structure 240 may be integrated with DWG along the length of DWG 200. In this example, an integrated circuit (IC) (not shown) may include a high frequency circuitry that produces a signal that is connected to a launching mechanism, such as a dipole antenna, that is configured to launch an electromagnetic signal into an adjacent DWG that is coupled to periodic structure 240. In this example, periodic structure 240 may be formed on a substrate 220. Substrate 220 may be part of the IC, or the IC may be mounted on substrate 220, for example.

As used herein, the term "periodic structure" refers to a structure that includes multiple elements that are spaced apart with approximately equal spacing. Typically, the spacing will be related to a wavelength of a signal with a selected frequency or range of frequencies that is intended to be affected by the periodic structure. A periodic structure is a single unit cell repeated in the x-y-z direction with some spacing. The structure may be repeated the entire length of the waveguide for cases where it is useful to affect the entire waveguide, or in specific places, such as at a bend, to help contain the fields or filter higher order modes caused by the bend, for example.

DWG periodic structure 240 has a first DWG portion 243, a second DWG portion 244, and one or more filter stubs 245. A signal propagating through DWG in either direction will pass through filter structure 240. In this example, DWG 200 and filter stubs 245 have a core made from a polymer dielectric material having a first dielectric constant $\in 1$ and a polymer cladding having dielectric constant $\in 2$, where $\in 1 > \in 2$. A metallic or other type of conductive coating 246 surrounds DWG filter structure 240.

One or more copies of periodic metal structure 240 may be integrated along the dielectric waveguide 200 to modify the frequency and dispersion characteristics of the dielectric waveguide interconnect. In this example, the length and position of the stubs determine the frequency characteristic of the interconnect. The ends of the stubs are blanked off to short-circuit them and thereby cause a boundary condition in which the electric field is zero. When the short-circuited stubs are odd multiples of approximately λ/4 long, then the field will be at a maximum in the waveguide core and the filter will be a band-pass filter, where λ represents the approximate wavelength of a target range of frequencies. When the stubs are odd multiples of approximately λ/2 long the filter will be a band-stop filter. The number of stubs affects the quality factor of the filter and the raw frequencies that are affected by the filter. The stubs are spaced to form a periodic structure with spacing typically in a range of λ/2-λ/8, for example.

As an electromagnetic (EM) signal wave propagates through filter structure 240, some signal energy may divert into the one or more filter stubs 245, depending on the wavelength of the EM signal and the physical dimensions of filter stubs 245. Reflected signal energy from filter stubs 245 may combine with the original EM signal in a constructive or destructive manner, depending on the physical size of filters stubs 245 and the EM signal frequency. In this manner, various types of high pass, low pass, band pass, band block, etc., filters may be constructed.

Figure 3:
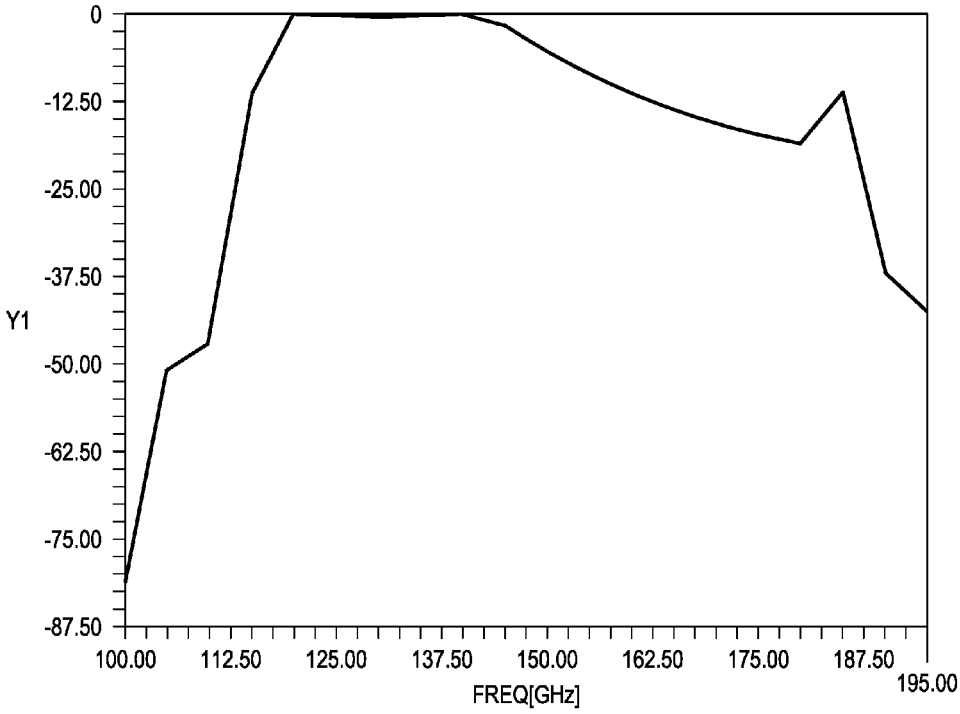
FIG. 3 is an example plot of S-parameters for the periodic structure of FIG. 2 illustrating its band-pass characteristic.

FIG. 3 is an example plot of S-parameters Y1 vs frequency in GHz for the periodic structure 240 (FIG. 2) illustrating its band-pass characteristic. In this example, stubs 245 (FIG. 2) are approximately $\lambda/4$ long for the illustrated frequency range and therefore the filter behaves as a band-pass filter in this frequency range.

Figure 4:
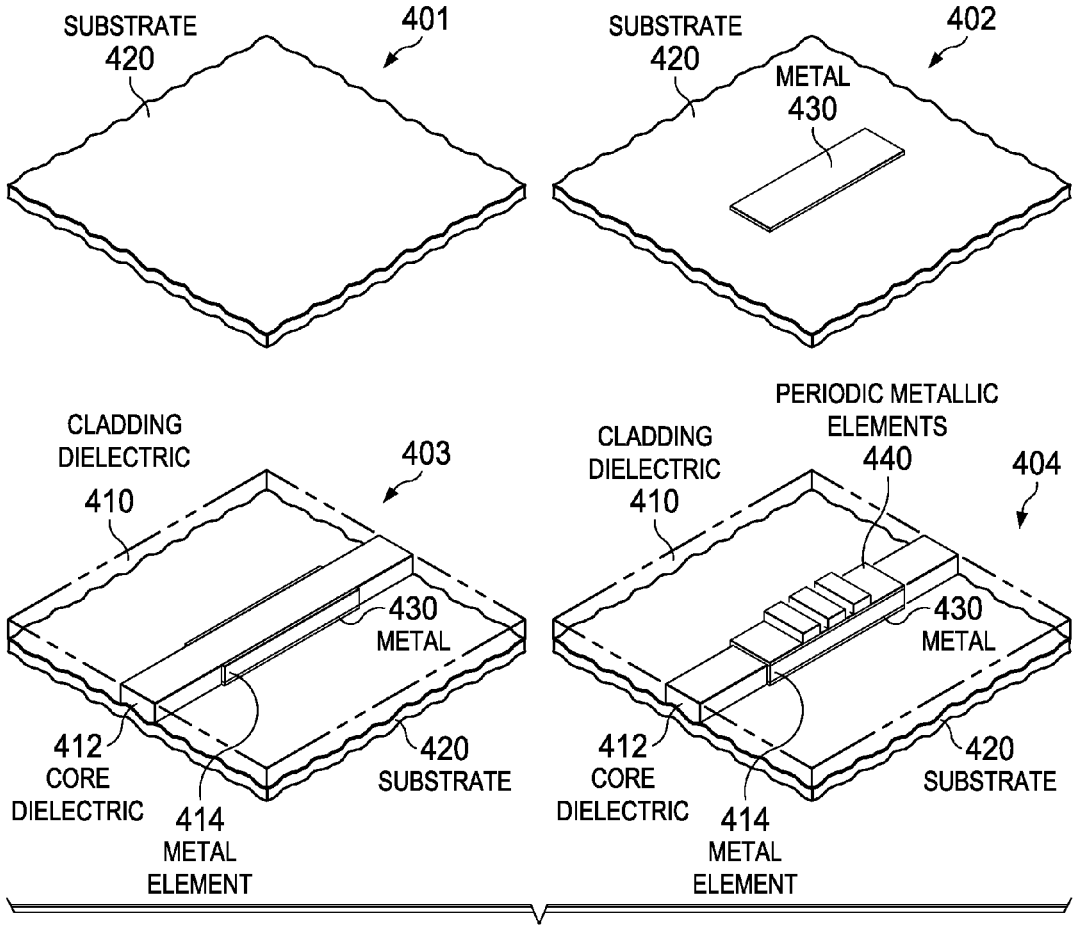
FIG. 4 is an illustration of a process flow for forming the integrated periodic structure of FIG. 2.

FIG. 4 is an illustration of a process flow for forming integrated periodic structures, such as filter structure 240 (FIG. 2), during the manufacture of a DWG, such as DWG 200 (FIG. 2), for example. A direct print method may be used to fabricate these metallic periodic structures periodically embedded within dielectric waveguides. This is made possible by a layer-by-layer methodology used in additive fabrication techniques such as inkjet-printing, for example. Other additive techniques may be used, such as screen-printing, flexographic printing, or 3D printing, for example.

In this example, a periodic metallic element 440, also referred to as "periodic structure 440" herein, embedded in a dielectric waveguide is formed on a substrate 420 onto which the waveguide with periodic metallic structure can be printed, as illustrated in step 401. This substrate may range from a die, package, or board, or to a substrate as simple as paper, for example.

Various layers of printed metal 430, 414 and dielectric material 410, 412 form the core of the waveguide and the walls of the metallic structure. In step 402, a conductive layer is printed to form the conductive bottom layer of periodic structure 440. Conductive layer 430, also referred to as "metal 430" herein, may be metallic or may be a conductive non-metallic material, for example. The printed dielectric deposited in step 403 may be composed of any insulating material which can be deposited in thick layers (polymers, oxides). The dielectric material may be deposited as a single bulk material with relative permittivity $\in r1$ and relative permeability $\mu r1$, or in multiple layers to form a graded-permittivity/permeability core with relative permittivities/permeability of $\in r1$-$\in rm$, $\mu r1$-$\mu rm$. The grading may be attained via use of different materials, or nanoparticle doping, for example. In this manner, cladding dielectric 410 and core dielectric 412 may be formed on a surface of substrate 420. Note that core dielectric 412 is formed on top of metal layer 430. A top layer of conductive material is deposited in step 404 to complete periodic structure 440.

In this manner, a printed metallic periodic structure may be processed during the waveguide fabrication to embed the element directly within the DWG. A printed metallic shell may totally surround the periodic structure and provide improved isolation, as compared to a dielectric only implementation. As illustrated in FIG. 4, the full metal jacket around periodic structure 440 does not require formation of vias, which reduces production cost.

EM signals propagating through a DWG may undergo changes in both amplitude and velocity. The magnitude may vary over a range of frequencies due to signal attenuation and dispersion, which may lead to changes in the power vs. frequency characteristic of a signal as it propagates through a DWG transmission system. Similarly, an EM signal may undergo changes in group velocity vs. freq which may affect phase relationships as a signal propagates through a DWG transmission system due to frequency dependent permittivity characteristics of the dielectric core, for example.

Periodic filtering structures may be fabricated to tailor the magnitude transmission response in several ways, such as by providing a bandstop for a particular frequency or range of frequencies, by providing a bandpass for particular frequency or range of frequencies, etc., for example. Similarly, periodic filtering structures may be fabricated to correct for phase changes in a signal due to dielectric material effects.

A wide array of other configurations of periodic metallic or non-metallic periodic structures may be used to control the dispersion and frequency characteristics of a dielectric waveguide interconnect. Additional examples are illustrated later in this disclosure.

Several configurations of dielectric waveguides and integrated periodic structures and methods for making them will now be described in more detail. In each example, periodic structures may be formed as part of the waveguide as described above.

Figure 5:
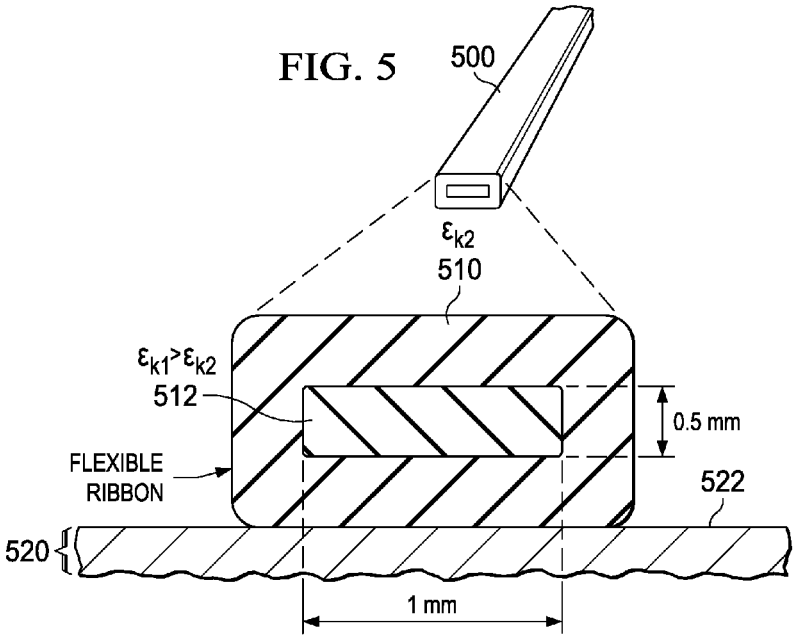
FIGS. 5-7 are illustrations of example waveguides.

FIG. 5 illustrates a DWG 500 that is configured as a thin flexible ribbon of a core dielectric material 512 surrounding by a dielectric cladding material 510. The core dielectric material 512 has a dielectric constant value $\in k1$, while the cladding material 510 has a dielectric constant value of $\in k2$, where $\in k1$ is greater than $\in k2$. In this example, a thin rectangular ribbon of the core material 512 is surrounded by the cladding material 510. For sub-terahertz signals, such as in the range of 130-150 gigahertz, a core dimension of approximately 0.5 mm×1.0 mm works well. DWG 500 may be fabricated conformably onto surface 522 of substrate 520 using the inkjet printing process or other 3D printing process described in more detail below.

In this example, dielectric clad DWG 500 is fabricated on a surface 522 of a substrate 520, as will be explained in more detail below. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 6:
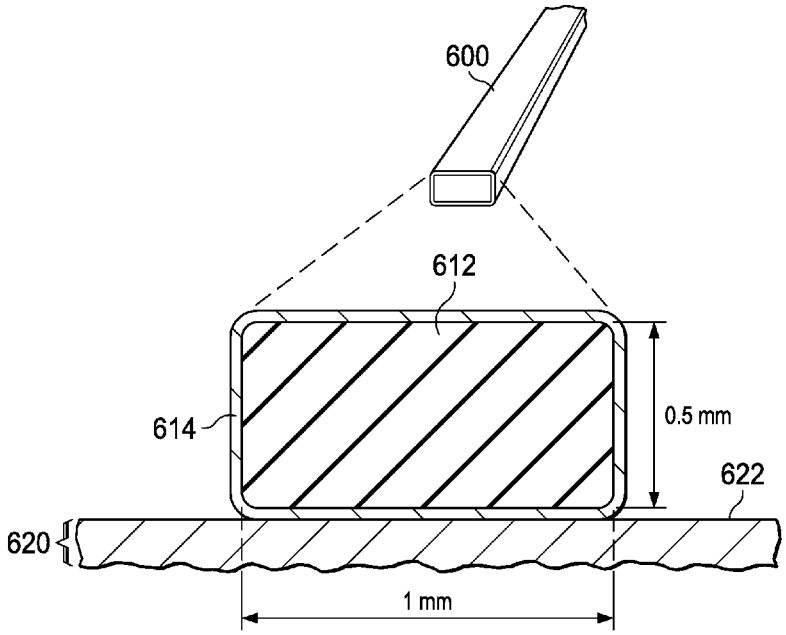

FIG. 6 illustrates a metallic, or other conductive material, clad DWG 600 that is configured as a thin ribbon of the core material 612 surrounding by the metallic cladding material 614. For sub-terahertz signals, such as in the range of 130-150 gigahertz, a core dimension of approximately 0.5 mm×1.0 mm works well.

In this example, metallic clad DWG 600 is fabricated on a surface 622 of a substrate 620. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 7:
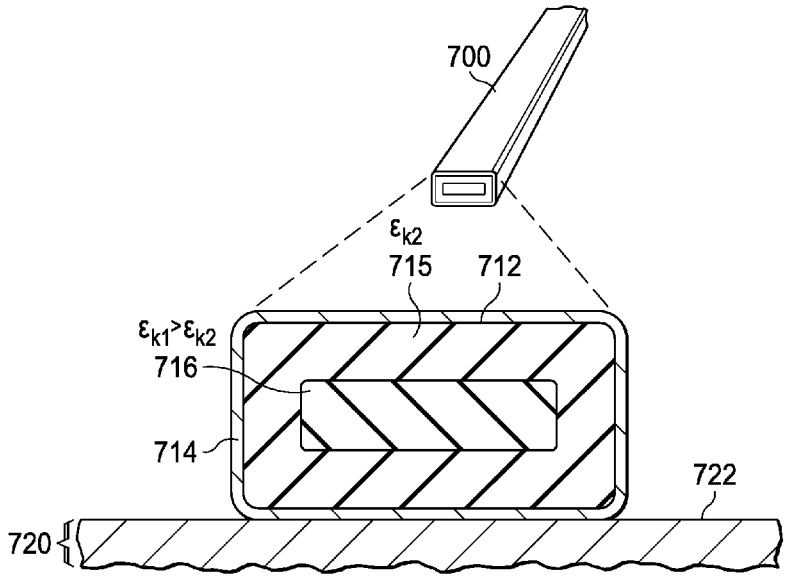

FIG. 7 illustrates a metallic, or other conductive material, clad DWG 700 that is configured as a thin ribbon of the core 712 surrounding by the metallic cladding material 714. In this example, core 712 is comprised of a thin rectangular ribbon of the core material 716 that is surrounded by a second layer of core material 715 to form a graded core 712. Core region 716 has a dielectric constant value of $\in k1$, while core region 715 has a dielectric constant value of $\in k2$, where $\in k1 > \in k2$. In another embodiment, graded core 712 may comprise more than two layers of core material, with each layer having a different relative dielectric constant value ranging from relative permittivity of $\in r1$-$\in rn$, for example. In another example, the graded core may be implemented in such a manner that the dielectric constant value gradually varies from a higher value in the center to a lower value at the outside edge. In this manner, a graded core may be provided that tends to confine the sub-THz frequency signal to the core material and thereby reduce cutoff effects that may be produced by the metallic cladding, for example.

In this example, metallic clad DWG 700 is fabricated on a surface 722 of a substrate 720. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 8:
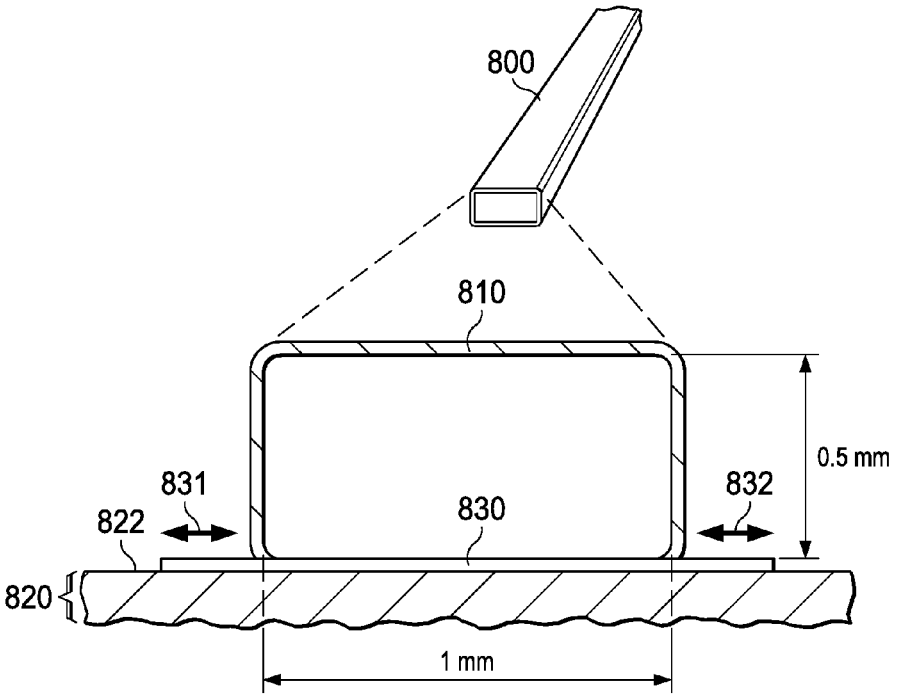
FIG. 8 illustrates another embodiment of any of the waveguides of FIGS. 9-11.

FIG. 8 illustrates another embodiment 800 of any of the waveguides of FIGS. 5-7. In this example, waveguide 800 is fabricated on a surface 822 of a substrate 820. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

For a metallic clad waveguide, such as those illustrated in FIGS. 6-7, a bottom portion of waveguide 800 may be formed by a conductive layer 830 that may extend along surface 822 beyond a footprint of waveguide 800, as indicated at 831, 832, for example. For a non-metallic DWG such as illustrated in FIG. 5, a bottom portion of waveguide 800 may be formed by a dielectric layer 830 that may extend along surface 822 beyond a footprint of waveguide 800, as indicated at 831, 832, for example. In either case, the extent of regions 831, 832 may be minimal, or they may cover an extended portion of surface 822, or even the entire surface 822, for example. Conductive layer 830 may be metallic or may be a conductive non-metallic material, for example. Cladding 810 may be metallic or otherwise conductive, or may be a dielectric.

Embodiments of the invention may be implemented using any of the dielectric core waveguides described above, for example. In each embodiment, one or more periodic filter structures may be embedded in the DWG to perform EM signal filtering as described above in more detail.

The various dielectric core waveguide configurations described above may be fabricated using a printing process, such as an inkjet printer or other three dimensional printing mechanism. Fabrication of three dimensional structures using ink jet printers or similar printers that can "print" various polymer materials is well known and need not be described in further detail herein. For example, see "3D printing," Wikipedia, Sep. 4, 2014. Printing allows for the rapid and low-cost deposition of thick dielectric and metallic layers, such as 0.1 um-1000 um thick, for example, while also allowing for fine feature sizes, such as 20 um feature sizes, for example. Standard integrated circuit (IC) fabrication processes are not able to process layers this thick. Standard macroscopic techniques, such as machining and etching, typically used to manufacture dielectric waveguides and metallic structures may only allow feature sizes down to 1 mm, for example. These thicker printed dielectric and metallic layers on the order of 100 nm-1 mm which are made possible by inkjet printing enable waveguide operation at Sub-THz and THz frequencies. Previously optical frequencies could be handled using standard semiconductor fabrication methods while lower frequencies may be handled using large metallic waveguides; however, there was a gap in technology for fabricating waveguides for THz signals. Printing the waveguides directly onto the chip/package/board mitigates alignment errors of standard waveguide assemblies and simplifies the packaging process.

Figure 9:
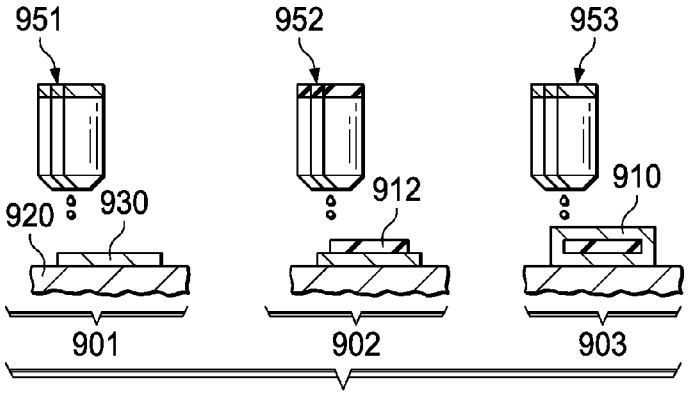
FIGS. 9-10 are process flow diagrams illustrating fabrication of various configurations of waveguides using a three dimensional printing process.
Figure 10:
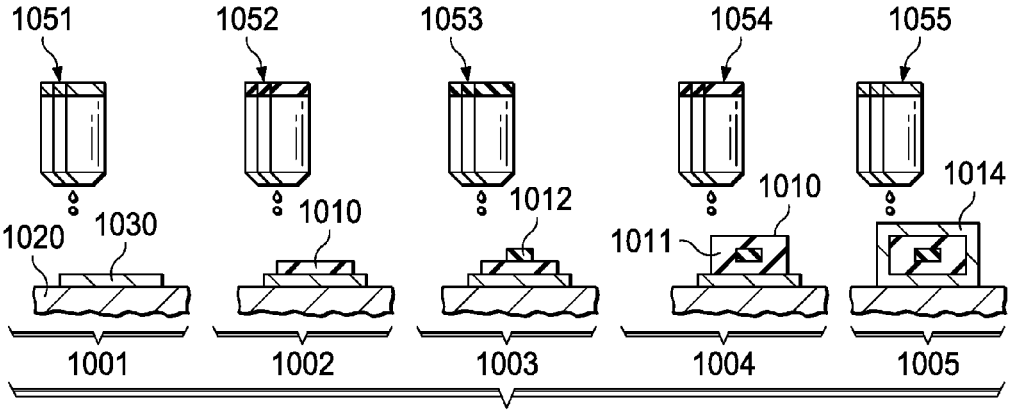

FIG. 9 is a process flow diagram illustrating fabrication of a waveguide with a dielectric core similar to FIGS. 9 and 10 using an ink jet printing process. In process step 901, an inkjet printing mechanism illustrated at 951 deposits a bottom layer 930 on a top surface of a substrate 920 using a known printing process. This bottom layer will form a bottom surface of the waveguide. Bottom layer 930 may be a dielectric layer for forming a dielectric waveguide similar to DWG 500. Similarly, bottom layer 930 may be a conductive layer for forming a conductive waveguide similar to DWG 600. Bottom layer 930 may be configured so that it only extends across the bottom region of the wave guide, as illustrated in FIGS. 5-6, or it may be configured to extend beyond the walls of the waveguide, as illustrated in FIG. 8. Bottom layer 930 extends the length of the waveguide and conforms to the top surface of substrate 920.

In another embodiment, bottom layer 930 may be prefabricated on the substrate; for example, it may be a conductive layer that is laminated on the surface of substrate 920. In this example, unneeded portions of the conductive layer may be removed by etching, for example, or by other known fabrication techniques for creating patterned features on a substrate. In another embodiment, bottom layer 930 may be formed by diffusion of a layer onto substrate 920, or by sputtering a layer onto substrate 920, or by flooding the surface of substrate 920 with a liquid or paste, etc., for example. In another embodiment, a stamped metal or dielectric shape may be laminated or otherwise affixed to substrate 920 to form bottom layer 930

In process step 902, a core member 912 is formed by printing a dielectric material to form the core of the waveguide. Multiple passes of print-head 952 may be required to obtain a desired thickness for core 912. The printed dielectric may be composed of any dielectric material which can be deposited in thick layers, such as polymers, oxides, etc., for example.

During process step 903, a conformal cladding coating is applied by print-head 953 to cover the top and sides of the waveguide. In this manner, core 912 is enclosed with a conductive cladding 910 or a dielectric cladding to form a waveguide. Various conductive materials that can be printed in this manner may be used to form coating 910, such as: a conductive ink with metallic filler, a conductive polymer formed by ionic doping, carbon and graphite based compounds, conductive oxides, etc., for example. Similarly, a dielectric material similar to base layer 930 may be used to form the cladding for a non-conductive DWG, for example.

FIG. 10 is a process flow diagram illustrating fabrication of a metallic periodic structure with a dielectric core using an ink jet printing process. In this example, a bottom conductive layer 1030 is formed on a top surface of substrate 1020 by a print-head 1051 during process step 1001, to form the bottom of the periodic structure. A bottom cladding layer 1010 is formed by print-head 1052 during process step 1002 in a similar manner as described above to form the DWG.

During process step 1003, the core 1012 is formed by print-head 1053 using a dielectric material that has a different dielectric constant than the material used for layer 1010. Then, in step 1004 an upper and side layer 1011 of dielectric material is applied by print-head 1054 to complete the cladding 1010 of the waveguide.

Multiple passes of print-head 1053 may be required to obtain a desired thickness for core 1012. The printed dielectric may be composed of any dielectric material which can be deposited in thick layers, such as polymers, oxides, etc., for example. Additional passes of print-head 1053 may be performed to form a periodic structure such as periodic structure 240, 440, referring back to FIGS. 2 and 4 respectively, for example.

In another embodiment, additional layers may be used to form graded core member 1012 using a range of relative permittivity of $\in r1$-$\in rn$, for example.

During process step 1005, a printed conductive coating 1014 is applied by print-head 1055 to cover the top and sides of the periodic structure. In this manner, a periodic structure such as 240, 440 is enclosed with a conductive cladding 1014, as discussed in more detail above.

The same steps that are used to form the periodic structure may also be used to form the rest of the DWG. Similarly, conductive cladding may be formed in other regions of the DWG besides the periodic structure.

For all of the waveguide embodiments described above, the waveguides may be printed arbitrarily long in a desired pattern in the plane of the substrate. However, the length of the DWG may be limited by the "attenuation budget" available since the transceiver must allow for a determined attenuation of the signal between signal transmission (TX) and signal reception (RX). The maximum length of the DWG depends on several factors, including: the material of the DWG, its attenuation, isolation properties bending loss and number of curves, etc., for example.

Printed waveguides may conform to the surface topology of the substrate. If the substrate is flexible, the waveguide may also be flexible as long as the materials used to print the waveguide are also flexible.

In another embodiment, the dielectric core may be formed in a such a manner that the dielectric core has a dielectric constant value that varies over at least two values along the longitudinal extent of the dielectric core. This may be done by printing different materials along the extent of the dielectric core, for example. This may be useful for matching impedance of the waveguide to another waveguide, for example.

Typically, using a lithographic process to form the dielectric core would produce essentially vertical sidewalls on the dielectric core. Deposition of a metallic material to cover the dielectric core may be difficult when the sides of the dielectric core are vertical. However, using an inkjet process to form the dielectric core and controlling the surface tension of the ink allows the slope, or angle, of the sidewalls of the printed waveguide to be controlled. Thus, the sidewalls of the dielectric core may be formed with a slight inward slope, or may be formed perfectly vertical, depending on the needs of the next processing step. In this manner, deposition of the metallic sidewalls may be improved. This may not be an issue in other 3D printing processes, however.

Figure 11:
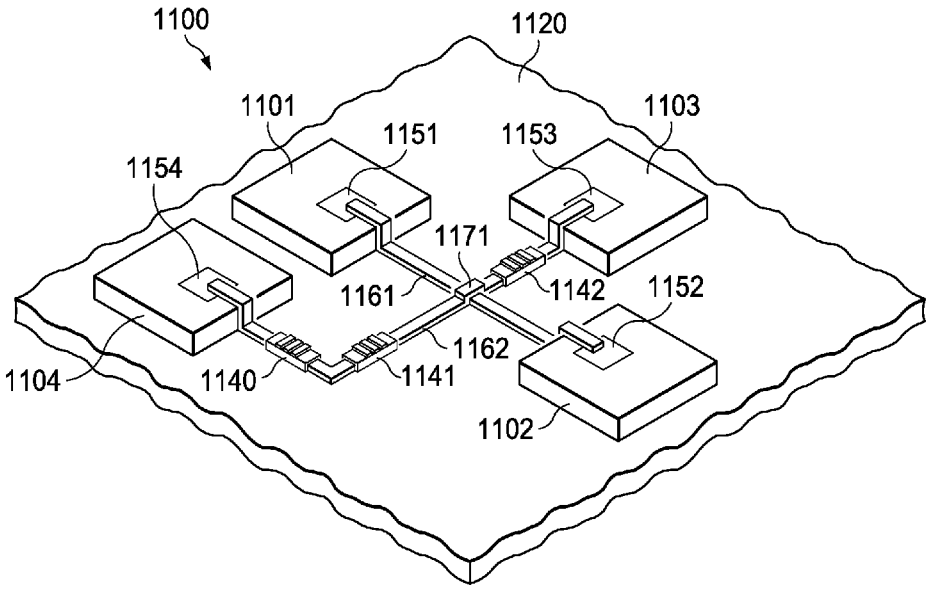
FIG. 11 is an illustration of a system illustrating various aspects of conformal waveguides.

FIG. 11 is an illustration of a system 1100 illustrating various aspects of conformal waveguides. In this example, four nodes 1101, 1102, 1103, 1104 with transceivers 1151, 1152, 1153, 1154 are mounted or otherwise formed on a surface of substrate 1120, as described in more detail above. Transceiver 1151 is coupled to transceiver 1152 by a waveguide 1161 that is also formed on the surface of substrate 1120 as described in more detail above. Likewise, transceiver 1153 is coupled to transceiver 1154 by a waveguide 1162 that is also formed on the surface of substrate 1120 as described in more detail above.

One or more periodic structures 1140, 1141, 1142 and 1143 may be included to provide signal compensation by passing or rejecting a particular signal frequency or range of frequencies, as discussed above in more detail. Periodic structures 1140-1141 are placed at a corner region of DWG 1162 in order to compensate for corner effects, for example. Periodic structures may be spaced along the length of DWG 1162 in an even spacing manner, or the spacing between each periodic structure may vary, as needed to perform signal compensation or to perform other functions, for example.

As described in more detail above, waveguides 1161, 1162 and periodic structures 1140-1143 may be formed directly on the surface of substrate 1120 using an inkjet process or other form of 3D printing. This process allows the wave guides to be formed on a chip die of each node and to then follow over the edge of each die an onto the surface of substrate 1120. In a similar manner, one waveguide, such as 1162, may be routed over the top of another waveguide, such as 1161, as indicated at 1171, for example.

In some embodiments, substrate 1120 may be a single integrated circuit that includes multiple functional nodes in a single SoC. In that case, the SoC may include an antenna or other coupling structure in each node such as node 1101-1104, with one or more DWGs coupled between the two nodes formed directly on the SoC substrate. In this manner, a wide degree a freedom is available to route multiple waveguides on a surface of the substrate, and to cross over other waveguides or other physical features that are present on the surface of the substrate.

As shown by the above descriptions and examples, multiple electronic devices may be easily interconnected to provide sub-terahertz communication paths between the electronic devices by using the techniques described herein.

Printable metallic waveguides on top of a chip, package, or board may be processed onto nearly any substrate (silicon, acrylic glass, plastic, paper, etc. . . . ). Printed dielectric layers on the order of 100 nm-1 mm which are made possible by inkjet printing enable waveguide operation at Sub-THz frequencies; previously only optical frequencies could be reached using standard fabrication methods. A metallic or otherwise conductive shell provides isolation over standard dielectric waveguides.

Thus, extremely low-cost and low-loss sub-THz signal routing waveguides may be printed onto nearly any substrate. Printing the waveguides directly onto the chip/package/board mitigates alignment errors of standard waveguide assemblies and simplifies the packaging process.

Figure 12:
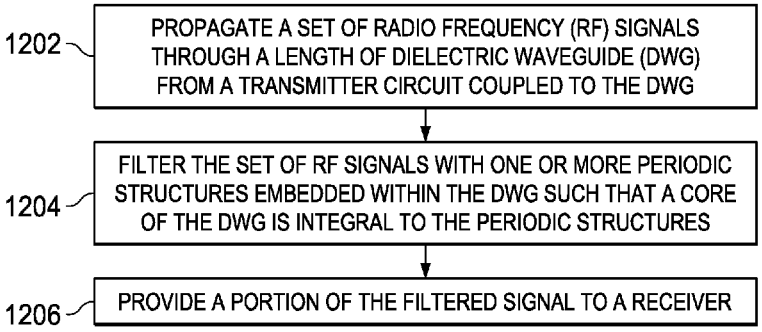
FIG. 12 is a flow chart illustrating signal transmission management using periodic structures in a waveguide system.
Figure 13A:
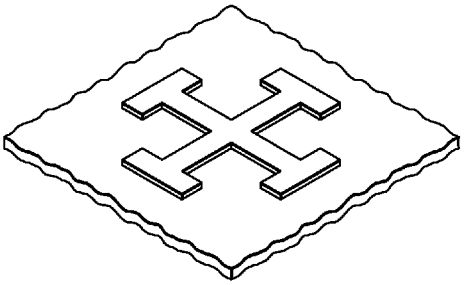
FIGS. 13A-13E, 14A-14C and 15A-15B illustrate alternative embodiments of periodic structures that may be integrated into a DWG.
Figure 13B:
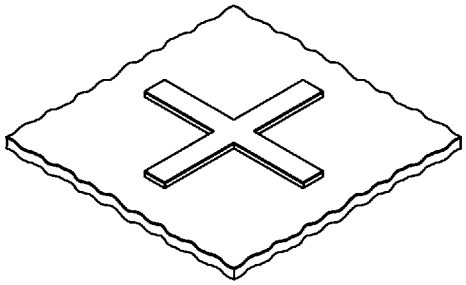
Figure 13C:
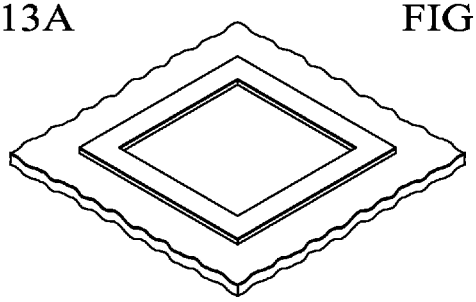
Figure 13D:
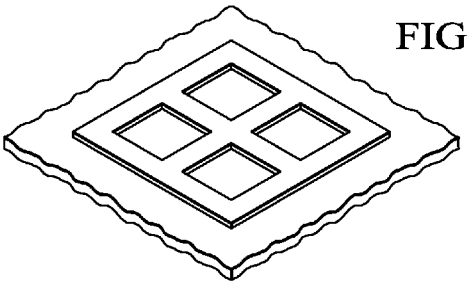
Figure 13E:
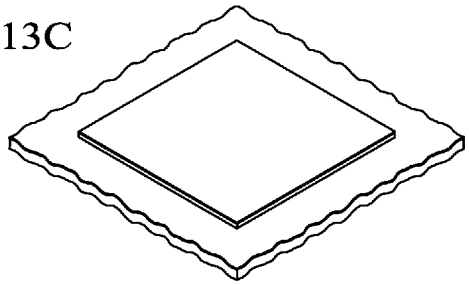

FIG. 12 is a flow chart illustrating signal transmission management using periodic structures in a dielectric waveguide system. A set of radio frequency (RF) signals is received on an input port of the DWG and propagated at step 1202 through a length of the DWG. While the signal may be "digital" in nature, a digital signal may be represented and analyzed as a set of frequencies.

As described above, while propagating through the DWG, the signal may undergo magnitude and phase distortion due to frequency dependent transmission characteristics of the dielectric material used to form the DWG.

The set of RF signals may be filtered at step 1204 with one or more periodic structures embedded within the DWG such that a core of the DWG is integral to the periodic structures, as described in more detail above, such as periodic structures 240, 440, for example. This filtering may compensate for magnitude and phase distortion experience by the signal as it propagates through the DWG. The periodic structures may attenuate one or more selected frequencies, for example.

The filtered set of RF signals may be provided at step 1206 to a receiver circuit coupled to the DWG. In this manner, magnitude distortion and/or phase distortion of the digital signal while propagating through the DWG may be minimized.

Periodic filtering structures may be fabricated as described above in more detail to tailor the magnitude transmission response in several ways, such as by providing a bandstop for a particular frequency or range of frequencies, by providing a bandpass for particular frequency or range of frequencies, etc., for example. Similarly, periodic filtering structures may be fabricated to correct for phase changes in a signal due to dielectric material effects.

FIGS. 13A-13E illustrate example alternative embodiments of elements that may be integrated into a DWG to form a periodic structure. These shapes are called frequency selective surface (FSS) unit cells. They may be planar or 3D and may be arrayed in 2D or 3D. The material may be ferroelectric, ferromagnetic, paramagnetic, etc., for example. FSSs have been intensively studied since the mid 1960s. Early FSS filters were mostly band pass filters, such as the Cassegainian sub-reflectors in parabolic dish antennas. The use of FSS unit cells in a quasi-optical application is described in "Quasi-Optical Notch Filter for ECEI Systems" The University of California Davis Millimeter-Wave Research Center, 2012, for example. FIG. 13-A depicts a cross used as a FSS element. It consists of a pair of crossed dipoles with end loading. FIG. 13-B depicts a cross FSS element. It resonates when its length equals a half wavelength of the transmitted signal. FIG. 13-C depicts a loop FSS element. The resonance of the loop occurs when the length approaches one wavelength of the transmitted signal. FIG. 13-D depicts an integrated square ring and cross dipole FSS used to create bandpass filters. FIG. 13-E depicts a square patch FSS and in arrays can be used for many applications: antennas, reflectors, EBG (Electronic Bandgap structures) or metamaterials used as high impedance design to eliminate transmission of signals.

Figure 14A:
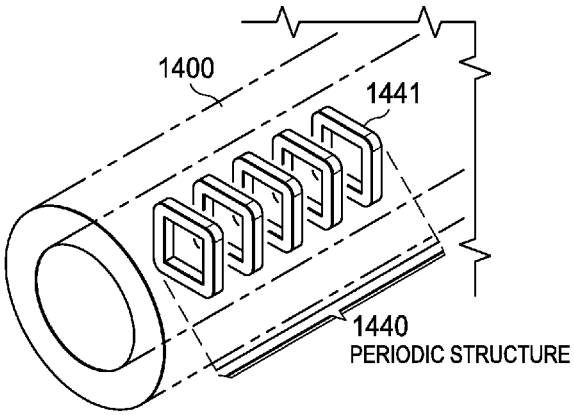
Figure 14B:
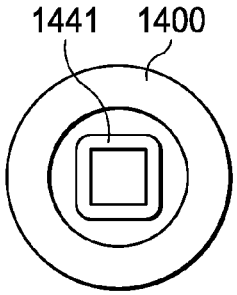
Figure 14C:
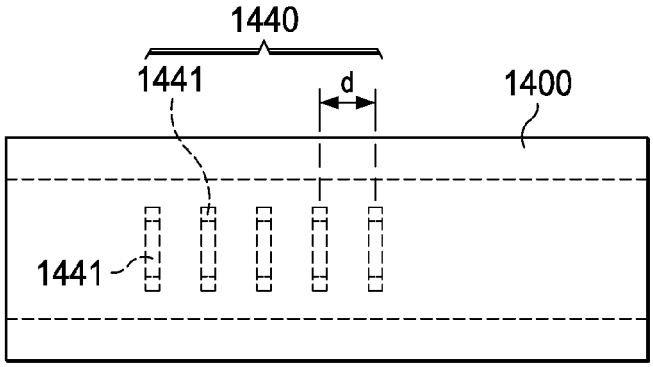

FIGS. 14A-14C illustrate a periodic structure 1440 (FIGS. 14A & 14C) that is embedded within DWG 1400. Periodic structures integrated within a DWG may protrude as illustrated in FIG. 2, or they may be totally embedded with a DWG, as illustrated here. The elements of a periodic structure may be formed from a wide selection of materials, such as: dielectric, magnetic, metallic, Metamaterials (negative epsilon and mu), etc., for example. A periodic structure may be a periodically repeated structure embedded within the waveguide itself, such as: spheres, cubes, fractals, etc., for example. A periodic structure may include any repeating pattern which has a lattice. The lattice may be square, hexagonal, octagonal, or n-sided where n is an integer, for example.

In some embodiments, the periodic structures may be fabricated using a paraelectric material or a ferromagnetic material. Biasing the paraelectric or ferromagnetic material using an electric or magnet field allows for tuning of the periodic structures which can be used for shifting the filtering frequency, modulating, isolating (unidirectional propagation in the case of the ferromagnetic materials), etc., for example.

FIG. 14A is an isometric view periodic structure 1440 that includes multiple FSS elements 1441, while FIG. 14B illustrates an end view of DWG 1400 with embedded FSS elements 1441, and FIG. 14C illustrates a side view of DWG 1400 with embedded periodic structure 1440. Periodic structure 1440 includes a number of elements 1441 that are each spaced apart by a distance d (FIG. 14C). Typically, distance d will be less than approximately $\lambda/8$. Typically, at least five elements will be included in each periodic structure. While a square element 1440 is illustrated here, any of the elements illustrated in FIGS. 13A-13E may be used, as well as other equivalent or similar geometric shapes, for example.

In addition to band pass or band stop filters, a periodic structure may perform other functions, such as: phase shifting, filtering, isolation (one directional propagation), tunable filtering, modulation (amplitude or phase), adaptive matching, etc., for example.

For adaptive matching, a periodic structure may be put at the input/output ends of a waveguide. Typically the transmitters and receivers have a variable input/output impedance which is dependent on the power level. By including tunable materials within the periodic structures, impedance matching may be adaptively optimized based on the power propagating through the waveguide, for example.

The embedded elements can also be polarization sensitive so if a signal is propagated through the waveguide which has multiple polarizations, the elements may be sensitized to act on only one or several of the polarizations.

Figure 15A:
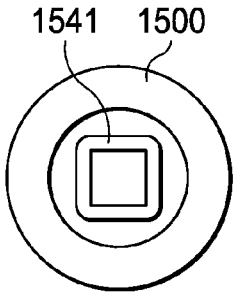
Figure 15B:
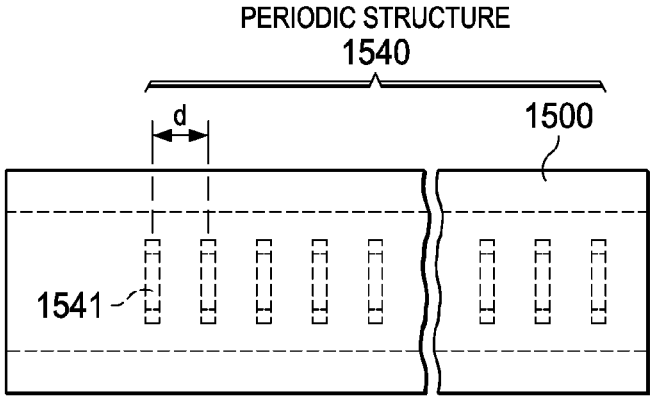

FIGS. 15A-15B illustrate another embodiment in which periodic structure 1540 (FIG. 15B) extends along a significant portion of the length of DWG 1500. Periodic structure 1540 (FIG. 15B) includes a number of elements 1541 that are each spaced apart by a distance d (FIG. 15B). This may be useful to provide continual phase correction along the length of DWG, for example. Typically, distance d will be less than approximately $\lambda/8$. While a square element 1541 is illustrated here, any of the elements illustrated in FIGS. 13A-13E may be used, as well as other equivalent or similar geometric shapes, for example.

Figure 16:
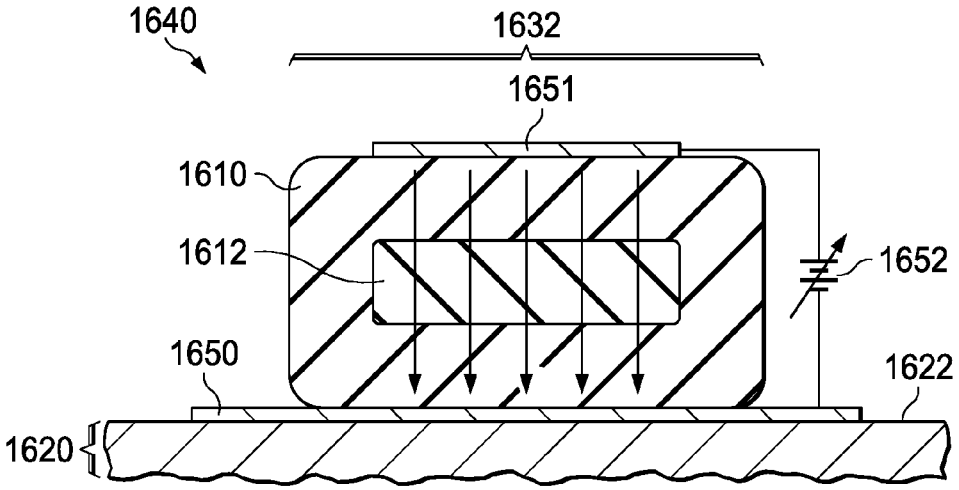
FIG. 16 a cross section of a portion of a periodic structure illustrating a variable voltage field for tuning the dielectric core material Other features of the present embodiments will be apparent from the accompanying drawings and from the detailed description that follows.

FIG. 16 is a cross section of a portion of a periodic structure 1640 illustrating a variable voltage field for tuning the dielectric of core material 1612, which is surrounded by cladding material 1610. Periodic structure 1640 may be similar to any of the periodic structures described above. The propagation velocity of an EM signal through a material is determined in part by the dielectric constant of the material. Therefore, the wavelength of the EM signal may be changed by changing the dielectric constant of the transmission media.

It is known that the dielectric constant of several high dielectric constant materials may change in the presence of a DC electric field. Tunable dielectric materials are materials whose permittivity (more commonly called dielectric constant) can be varied by varying the strength of an electric field to which the materials are subjected. Even though these tunable dielectric materials work in their paraelectric phase above the Curie temperature, the dielectric materials are conveniently called "ferroelectric" because they exhibit spontaneous polarization at temperatures below the Curie temperature. Tunable ferroelectric materials including barium-strontium titanate (BST) or BST composites have been reported. Strontium titanate may be used at low temperatures.

This technique may be applied to any of the periodic structures described above, for example. In this example, device 1640 is fabricated on a substrate 1620, which may be flexible or rigid in different embodiments. An electrode 1650 may be formed on a surface 1622 of substrate 1620. A matching electrode 1651 may be formed on the top of DWG portion 1632. The electrodes 1650, 1651 may cover a portion or most of the DWG portion 1632. In another embodiment, the matching electrodes may be formed on the sides of DWG portion 1632, rather than on the top and bottom, for example.

Dielectric core material 1612 is a tunable high dielectric material, such as BST, Zinc oxide (ZnO), etc., for example. Alternatively, dielectric core material 1612 may be a polymer that is doped with high dielectric particles, such as BST, ZnO, etc., for example. The particles may be nm or um sized, for example. A variable voltage source 1652 may be connected across electrodes 1650, 1651 and used to tune the dielectric constant value of core material 1612 and to thereby tune the filter characteristics of filter 1600. Control logic may be coupled to the variable voltage source to control tuning of device 1600.

In another embodiment, a variable magnetic field may be applied in place of a variable electric field to provide tuning of a periodic structure.

In this manner, an array of metallic, dielectric, or magnetic shapes may be organized as a lattice within a waveguide to form a periodic structure that may provide several types of desired effects. Within a given DWG, two or more types of periodic structures may be embedded to provide multiple functions, for example. In some embodiments, an electrical or magnetic field may be used to tune the operation of the periodic structure.

Other Embodiments

While the invention has been described with reference to illustrative embodiments, this description is not intended to be construed in a limiting sense. Various other embodiments of the invention will be apparent to persons skilled in the art upon reference to this description. For example, while a dielectric waveguide has been described herein, another embodiment may use a metallic or non-metallic conductive material to form the top, bottom, and sidewalls of the wave guide, such as: a conductive polymer formed by ionic doping, carbon and graphite based compounds, conductive oxides, etc., for example. As used herein, the term "conductive waveguide" refers to a waveguide having either metallic or non-metallic conductive sidewalls.

While waveguides with polymer dielectric cores have been described herein, other embodiments may use other materials for the dielectric core, such as ceramics, glass, etc., for example.

A DWG may include a single periodic structure. In another embodiment, periodic structures may be integrated along a DWG in an evenly spaced manner, or they may be positioned with variable spacing, depending on the function of the periodic structures.

In some embodiments, a ferroelectric material may be printed in conjunction with a polymeric dielectric or in place of a polymeric dielectric to form a dielectric core that permits EM signal propagation in one direction through the DWG, but blocks propagation in the other direction.

The substrate on which a dielectric core waveguide is formed may be rigid or flexible, planar or non-planar, smooth or irregular, etc., for example. Regardless of the topology of the substrate, the dielectric core waveguide may be formed on the surface of the substrate and conform to the topology of the surface by using the additive processes described herein.

While dielectric cores with a rectangular cross section are described herein, other embodiments may be easily implemented using the printing processes described herein. For example, the dielectric core may have a cross section that is rectangular, square, trapezoidal, cylindrical, oval, or many other selected geometries. Furthermore, the processes described herein allow the cross section of a dielectric core to change along the length of a waveguide in order to adjust impedance, produce transmission mode reshaping, etc., for example.

In some embodiments, the substrate may be removed after forming a waveguide using the inkjet printing or other 3D printing process by dissolving the substrate with an appropriate solvent or melting a heat sensitive substrate, for example. In this manner, a free standing waveguide that may have a complicated shape may be formed using the ease of fabrication and optional material variations available as described herein.

The dielectric core of the conductive waveguide may be selected from a range of approximately 2.4-12, for example. These values are for commonly available dielectric materials. Dielectric materials having higher or lower values may be used when they become available.

While formation of a conductive waveguide by directly printing the waveguide onto the substrate using a layer-by-layer additive fabrication technique such as inkjet-printing is described herein, other additive techniques such as screen-printing, flexographic printing, or 3D printing may also be used.

While DWGs and metallic or otherwise conductive waveguides are described herein, the inkjet and 3D printing techniques described herein may also be used to form other forms of waveguides, micro-coaxial, etc., for example that conform to a surface of a substrate.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A dielectric waveguide interconnect system comprising:

a dielectric waveguide (DWG) having a length; wherein the DWG has a core surrounded by a cladding, and one or more periodic structures embedded along the length of the DWG such that the core of the DWG is integral to each of the one or more periodic structures, wherein the one or more periodic structures are clad with a conductive layer.

2. The DWG interconnect system of claim 1, further comprising a substrate having a surface, wherein the DWG is formed on the surface of the substrate.

3. The DWG interconnect system of claim 2, further comprising:

a transmitting device mounted on the surface of the substrate being coupled to the DWG and operable to launch a radio frequency (RF) signal into the DWG; and a receiving device mounted on the surface of the substrate being coupled to the DWG and operable to receive a portion of the RF signal from the DWG.

4. The DWG interconnect system of claim 1, wherein at least one of the one or more periodic structures contains a ferroelectric dielectric.

5. The DWG interconnect system of claim 1, further comprising a field generator arranged adjacent at least one of the one or more periodic structures, such that a variable field is produced across the at least one of the one or more periodic structures.

6. A dielectric waveguide interconnect system comprising:

a dielectric waveguide (DWG) having a length; wherein the DWG has a core surrounded by a cladding, one or more periodic structures embedded along the length of the DWG such that the core of the DWG is integral to each of the one or more periodic structures; and a field generator arranged adjacent at least one of the one or more periodic structures, such that a variable field is produced across the at least one of the one or more periodic structures.

7. The DWG interconnect system of claim 6, wherein at least one of the one or more periodic structures contains a ferroelectric dielectric.

8. A method for forming a waveguide, the method comprising:

forming a conformal base layer for the waveguide and for one or more periodic structures on a surface of a substrate;

forming an elongated core region for the waveguide and for the one or more periodic structures on the base layer; and forming sidewalls and a conformal top layer surrounding the elongated core region and the one or more periodic structures and in contact with the base layer;

wherein the one or more periodic structures are formed entirely within the elongated core region of the waveguide.

9. A dielectric waveguide interconnect system comprising:

a dielectric waveguide (DWG) having a length; wherein the DWG has a core surrounded by a cladding, and one or more periodic structures embedded along the length of the DWG such that the core of the DWG is integral to each of the one or more periodic structures, wherein each periodic structure comprises a plurality of elements arranged in a lattice such that the entire lattice is embedded within the core of the DWG;

wherein each element of the lattice is spaced apart by a distance of less than or equal approximately one half a wavelength of a selected radio frequency.

10. A method for forming a waveguide, the method comprising:

forming a conformal base layer for the waveguide and for one or more periodic structures on a surface of a substrate;

forming an elongated core region for the waveguide and for the one or more periodic structures on the base layer; and forming sidewalls and a conformal top layer surrounding the elongated core region and the one or more periodic structures and in contact with the base layer;

wherein the substrate includes other structures that form an irregular surface and wherein the base layer is formed to conform to the irregular surface of the substrate and the other structures.

11. A method for forming a waveguide, the method comprising:

forming a conformal base layer for the waveguide and for one or more periodic structures on a surface of a substrate;

forming an elongated core region for the waveguide and for the one or more periodic structures on the base layer; and forming sidewalls and a conformal top layer surrounding the elongated core region and the one or more periodic structures and in contact with the base layer;

wherein the base layer, the sidewalls, and the top layer are formed by three dimensional printing onto the surface of the substrate.

12. A method for operating a dielectric waveguide interconnect system, the method comprising:

propagating a set of radio frequency (RF) signals through a length of dielectric waveguide (DWG) from a transmitter circuit coupled to the DWG;

filtering the set of RF signals with at least one periodic structure integrated with the DWG such that a core of the DWG is integral to the periodic structure; and providing the filtered set of RF signals to a receiver circuit coupled to the DWG; and applying a variable field across a portion of the at least one periodic structure to tune a characteristic of the at least one periodic structure.

13. The method of claim 12, wherein filtering the set of RF signals attenuates one or more selected RF frequencies.

14. A method for operating a dielectric waveguide interconnect system, the method comprising:

propagating a set of radio frequency (RF) signals through a length of dielectric waveguide (DWG) from a transmitter circuit coupled to the DWG;

filtering the set of RF signals with at least one periodic structure integrated with the DWG such that a core of the DWG is integral to the periodic structure;

wherein filtering the set of RF signals corrects a phase change of one or more selected RF frequencies; and providing the filtered set of RF signals to a receiver circuit coupled to the DWG.

15. A method for forming a waveguide, the method comprising:

forming a conformal base layer for the waveguide and for one or more periodic structures on a surface of a substrate;

forming an elongated core region for the waveguide and for the one or more periodic structures on the base layer; and forming sidewalls and a conformal top layer surrounding the elongated core region and the one or more periodic structures and in contact with the base layer;

wherein forming the one or more periodic structures comprises forming a lattice of repeating shapes using a material that is different from the core material.

* * * * *